US005882144A

United States Patent [19]

Lemperiere

[11] Patent Number: 5,882,144

[45] Date of Patent: Mar. 16, 1999

[54] DEVICE AND METHOD FOR TRIGGERING THE DESTRUCTION OF A SELECTED PART OF A HYDRAULIC STRUCTURE, SUCH AS A LEVEE, A DIKE OR A BACKFILLED DAM, AND HYDRAULIC STRUCTURE COMPRISING SUCH A DEVICE

[75] Inventor: François Lemperiere, Meudon, France

[73] Assignee: Hydroplus, Nanterre, France

[21] Appl. No.: 945,281

[22] PCT Filed: Apr. 16, 1996

[86] PCT No.: PCT/FR96/00577

§ 371 Date: Oct. 17, 1997

§ 102(e) Date: Oct. 17, 1997

[87] PCT Pub. No.: WO96/33312

PCT Pub. Date: Oct. 24, 1996

[30] Foreign Application Priority Data

Apr. 19, 1995 [FR] France ..... 95 04638

[51] Int. Cl.[6] ..... E02B 3/00; E02B 8/06

[52] U.S. Cl. ..... 405/80; 405/90; 405/94; 405/102; 405/108

[58] Field of Search ..... 405/80, 87, 90, 405/94, 99, 100, 101, 102, 107, 108, 110, 111, 114, 115, 192

[56] References Cited

U.S. PATENT DOCUMENTS

| | | | |
|---|---|---|---|
| 1,455,586 | 5/1923 | Hajek | 405/100 X |
| 2,598,389 | 5/1952 | Jermar | 405/94 |
| 4,661,014 | 4/1987 | Aubert | 405/111 |
| 4,787,774 | 11/1988 | Grove | 405/94 |
| 5,032,038 | 7/1991 | Lemperiere | 405/90 X |
| 5,061,118 | 10/1991 | Lemperiere | 405/108 |
| 5,195,846 | 3/1993 | Lemperiere | 405/90 |
| 5,222,834 | 6/1993 | Schultz | 405/94 |

FOREIGN PATENT DOCUMENTS

| | | | |
|---|---|---|---|
| 2011736 | 4/1994 | Russian Federation . | |
| 2088935 | 6/1982 | United Kingdom | 405/102 |

*Primary Examiner*—Tamara L. Graysay
*Assistant Examiner*—Jong-Suk Lee
*Attorney, Agent, or Firm*—Amster, Rothstein & Ebenstein

[57] ABSTRACT

This device for triggering the destruction of a selected portion (1 or 11) of a hydraulic structure such as an embankment dam, dike, or levee built out of erodible material so as to be destroyable by hydraulic erosion is constituted by at least one massive element (5) which is disposed on the top of the selected portion (1, 11) of the structure and which is held there by gravity, the massive element (5) being dimensioned in size and in weight in such a manner as to be expelled by the water when it reaches a predefined level (N), the vertical dimension of the massive element measured beneath said predefined level (N) being selected in such a manner that the nappe which is released after the massive element has been expelled is of a thickness (z) suitable for causing reliable and rapid destruction of the selected portion (1, 11) of the hydraulic structure.

14 Claims, 6 Drawing Sheets

H1
7
B
22
5
W
U
L
RM
P
Z
3
1,11
6,12
17
21
N1
N2
N
RN

DEVICE AND METHOD FOR TRIGGERING THE DESTRUCTION OF A SELECTED PART OF A HYDRAULIC STRUCTURE, SUCH AS A LEVEE, A DIKE OR A BACKFILLED DAM, AND HYDRAULIC STRUCTURE COMPRISING SUCH A DEVICE

BACKGROUND OF THE INVENTION

The present invention relates to a device for triggering the destruction of a selected portion of a hydraulic structure, and to a hydraulic structure including such a devices The invention applies in particular to an earthfill or rockfill embankment dam, dike, or levee, or to a composite dam or dike built in part as an embankment and in part out of concrete or masonry. The dike may be a front dike (across a water course) or a side dike (along a water course, to protect surrounding land from flooding). If the structure is a dam, it may be any kind of embankment or composite dam that creates a reservoir of water, or a saddle dam associated with the above-specified dam.

In numerous hydraulic structures of the above-indicated kind, it is known to provide privileged break points which, under exceptional flooding that is in danger of destroying the structure, give way at predetermined locations of the structure which are selected so as to minimize damage caused to the structure itself and/or to people or property flooded by the structure breaking. One of the major problems associated with such a system is that of satisfying the following criteria:

it must be very stable and reliable during normal operation of the hydraulic structure; and it must be very unstable when exceptional events occur that threaten the survival of the hydraulic structure.

The system that is presently in most widespread use for this function is known as a "fuseplug dike". It comprises either a portion of the hydraulic structure itself or else a dike built at a distance from the hydraulic structure at some other point on the periphery of the reservoir, e.g. in a saddle. The top of the fuse-plug dike is positioned or levelled at a level such that water spills over it only during exceptional flooding. This level is higher than the normal operating level (RN) of the hydraulic structure in which the fuseplug dike is integrated or with which it is associated, but it is lower than the maximum water level (RM) that the structure is designed to withstand. The fuseplug dike is built of materials suitable for ensuring that it is destroyed by hydraulic erosion in the event of water spilling over its top. The principle on which such a fuseplug dike operates is simple, but it suffers from uncertainty concerning the water level at which the erosion phenomenon will begin and as to the speed with which said fuseplug will be destroyed.

The resistance to erosion of an embankment dam or dike depends on numerous parameters, and in particular:

the thickness of the nappe passing over the top of the dike;

the duration of the spillage;

the nature of the materials constituting the embankment of the dike and the density thereof (and thus in particular the extent to which the embankment is compacted in an earthfill dam);

the standard cross-section of the dike;

the gradient of the downstream slope which, together with the thickness of the nappe, determines the speed water flows over the downstream slope; and the presence or absence of protection on the downstream slope; for example the presence of grass or other vegetation on the downstream slope increases the resistance of the dike to erosion.

Since fuseplug dikes must destruct only for flooding of very low probability, in particular exceptional floods of the kind that occur once in 100 years or in 1,000 or more years, there is uncertainty concerning how some of the above-mentioned parameters will vary over time (e.g. the plant cover on the downstream slope).

Tests on scale models and real-life experience on embankment dams or dikes that have suffered spillage over their tops have shown that they are sometimes capable of withstanding nappes that are several tens of centimeters thick (i.e. the height of the nappe is several tens of centimeters) for several hours (see the report of the 16th International Congress on Large Dams, Q.63-R.35, 13–17 Jun. 1988, pages 560 to 569, and in particular Table 1 on page 563). As a result, in the event of an exceptional flood, if the fuseplug dike is not destroyed rapidly, water can continue to accumulate upstream of the dike and can rise to a level that presents a danger for the remainder of the hydraulic structure before the fuse-plug dike has been destroyed.

In an attempt to remedy this drawback, proposals have been made to create at least one pilot channel or breach in the top of the fuseplug dike with the bottom thereof being at a level that is lower than the level of the top of the fuseplug dike, so that water passing over the bottom of the pilot breach also attacks the flanks thereof and thus destroys the fuseplug dike more quickly (see the report of International Symposium on Dams and Exceptional Floods, Grenada, 16 Sep. 1992, Volume III, article by Nelson L. de S. PINTO, pages 34 to 39, and article by Dr. Chonggang SHEN, pages 71 to 83, FIG. 1*b*). However, it has been observed that in the event of spillage, erosion does not begin at the bottom of the pilot breach but begins lower down, at the foot of the downstream slope of the dike, and the flanks of the pilot breach are eroded to a significant extent only after the portion of the downstream slope situated beneath the bottom of the pilot breach has itself been destroyed. From the point of accuracy concerning the water level at which destruction of said fuseplug begins and from the point of view of speed of such destruction, a fuseplug dike with a pilot breach therefore provides little improvement over a fuseplug dike without a pilot breach.

Proposals have also been made to place a cylinder having a diameter of 4 feet (about 1.2 m) at the top of the impervious core of the fuseplug dike, immediately beneath the bottom of the pilot breach, which cylinder is embedded in the embankment of the dike (see the report of the U.S. Committee on Large Dams, Modification of Dams to Allow Large Floods to Pass, 12th Series of USCOLD Annual Conferences, Forth Worth, Tex., April 1992, article by Paul F. Bluhm et al., pages 1 to 25, FIG. 7). In the event of exceptional flood, the water pouring through the pilot breach erodes the sand that is to be found in front of the cylinder. After a certain length of time, once the sand has been expelled in front of the cylinder, the cylinder itself is expelled by the water, thereby releasing a rush of water whose thickness corresponds to the diameter of the cylinder. The rush of water released in this way accelerates the erosion of the pilot breach. Although such a known system does indeed make it possible to obtain rapid erosion of the pilot breach once the cylinder has been expelled by the water, the time at which the cylinder is expelled and the level that had been reached at that time by the water upstream from the fuseplug dike cannot be determined accurately in advance. The time and the level depend, in particular, on the speed with which erosion takes place in front of the cylinder.

The speed of such erosion itself depends on numerous parameters such as those mentioned above concerning erosion of the dike, and some of the parameters can change over time between the time at which the dike was built and the time at which it needs to be destroyed by an exceptional flood. In addition, it has been observed that because of its weight the cylinder sinks partially into the impervious core of the dike and the core tends to retain the cylinder prior to it being expelled by the water. Here again, with the known system, it therefore remains uncertain as to how quickly the fuseplug dike will be destroyed and as to the level which the water will have reached immediately before the dike is destroyed.

An object of the present invention is thus to provide a device enabling destruction of a selected portion of a hydraulic -structure such as an embankment dam, dike, or levee confining a water reservoir or a water course to be triggered reliably and quickly when the water level reaches a predefined level, and in particular enabling the destruction of a fuseplug dike or of any other selected portion of a structure that is built out of erodible materials so as to enable it to be destroyed by hydraulic erosion.

SUMMARY OF THE INVENTION

The device of the invention is characterized in that it is constituted by at least one massive element made of a material that is not erodible and that is impervious to water, which element is placed on the top of said selected portion of the structure and is held thereon by gravity, said massive element being dimensioned in size and in weight so as to be expelled by the water when it reaches a predefined level, the vertical dimension of the massive element measured beneath said predefined level being selected in such a manner that the nappe which is released after the massive element has been expelled is of a thickness suitable for causing reliable and rapid destruction of said selected portion of the structure.

In order to further improve accuracy of the trigger device, a chamber may be formed at the base of the massive element between the element and a surface supporting it, and pressurization means may be provided to fill said chamber with water and create upwardly directed thrust under the massive element when the water of the reservoir or the water course reaches said predefined level.

For the massive element, it is advantageous to use elements of the kind described in patent EP-0 493 183, (see also patent EP-0 434 521), providing they are dimensioned as specified above. The elements described in patents EP-0 434 521 and EP-0 493 183 are "raising" elements designed to be placed on the top of the spillway sill of a hydraulic structure such as a dam or a dike, and which serve, as indicated by their name, to raise the normal retention level (RN) of the hydraulic structure without the safety thereof suffering in the event of a flood. When raising elements such as those described in the two above-specified patents are used in accordance with the present invention, they are placed on the top of a fuseplug dike or on any other selected portion of a hydraulic structure built of materials that enable it to be destroyed by hydraulic erosion, and their function is not to raise the normal retention level of the structure, but to serve as a trigger device to cause reliable and rapid destruction of the fuseplug dike or of said selected portion of the hydraulic structure once the water reaches a predefined level.

The invention also provides a hydraulic structure, in particular an embankment dam, dike, or levee, in which at least a selected portion is built out of material enabling it to be destroyed by hydraulic erosion so as to enable an exceptional flood to be discharged via the selected portion of the structure which is destroyed without the remainder of the structure or other structures associated therewith being destroyed by the exceptional flood, the top of said selected portion of the structure being at a first predefined level lower than a maximum water level that the remainder of the structure or the structures associated therewith are designed to withstand. The hydraulic structure of the invention is characterized in that at least a portion of the top of said selected portion of the structure is prepared to receive at least one massive element which is placed and held by gravity on said prepared portion of the top, said massive element being dimensioned in size and in weight in such a manner as to be expelled by the water when it reaches a second predefined level lying between said first predefined level and said maximum water level, the first and second predefined levels being selected in such a manner that the difference between them gives rise, once the massive element has been expelled, to a nappe whose thickness causes reliable and rapid destruction of said selected portion of the structure. Preferably, the difference between the first and second predefined levels is at least two meters.

BRIEF DESCRIPTION OF THE DRAWING

Other characteristics and advantages of the invention appear from the following description of two embodiments of the invention given by way of example with reference to the accompanying drawings, in which.

DETAILED DESCRIPTION OF THE PREFERRED EMBODIMENTS

Figure 1:
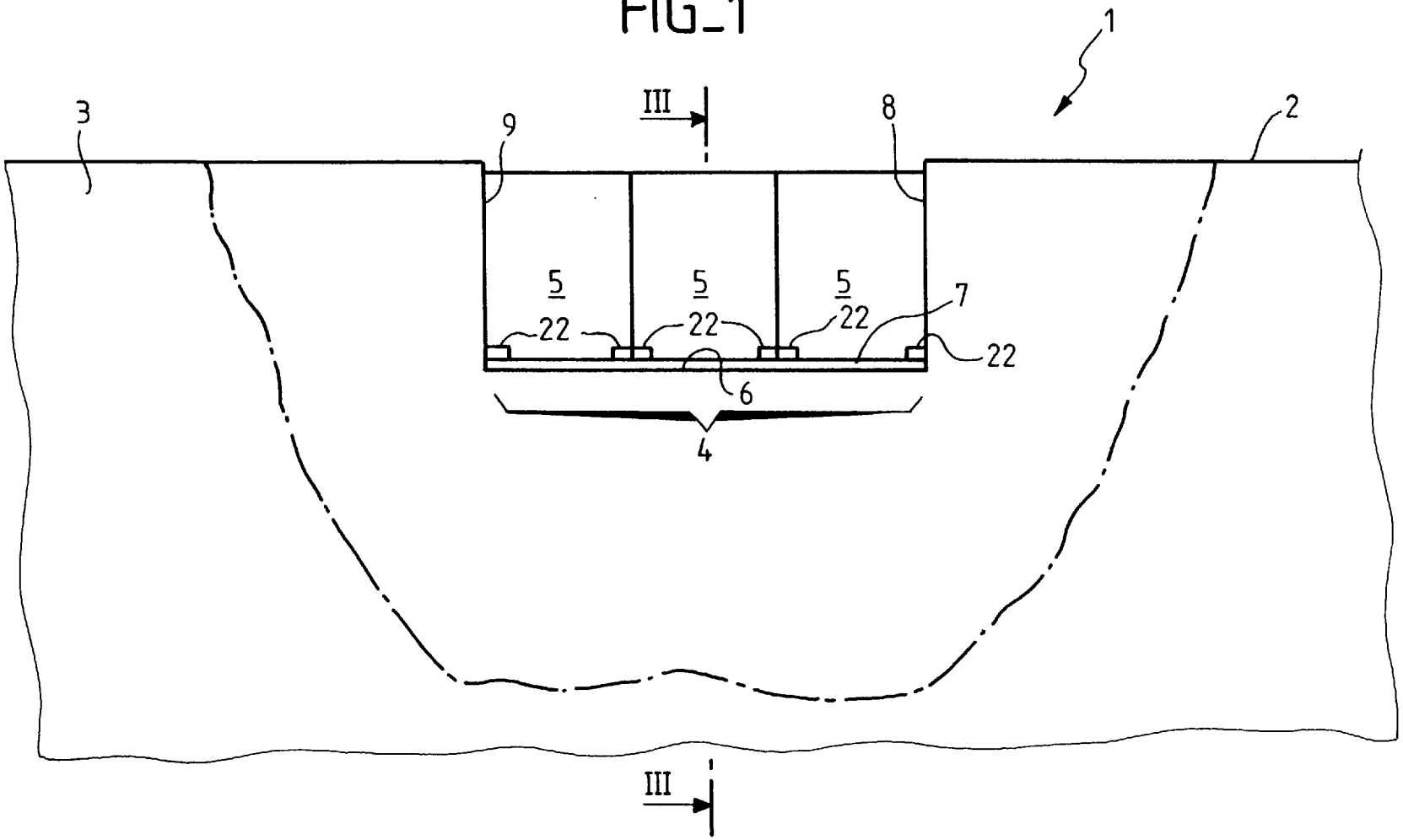
FIG. 1 is front elevation view of a portion of an embankment dam or dike including a pilot breach in which a trigger device of the present invention is installed.

The dike portion 1 shown in FIG. 1 may be a portion of a fuseplug dike or a selected portion of an embankment dam, dike, or levee, built of materials that can be eroded by water. It is not necessary for the dike portion concerned to have been originally designed so as to be destroyed in the event of water spilling over its top. The invention serves to trigger destruction of a selected portion of a hydraulic structure (in order to release an exceptional flood through a selected point of the hydraulic structure) even if said selected portion of the structure was not designed for that purpose when the hydraulic structure was built, although this applies only if it was originally built out of materials that can be eroded by water. In practice, the invention can be applied to any embankment dam or dike (rockfill or earth-fill), whether already built or new.

In FIG. 1, numeral 2 designates the top of dike portion 1, numeral 3 the downstream slope of the dike, and numeral 4 a pilot channel or breach formed in the top 2 of the dike. If the dike portion 1 that is to be destroyed is very long, then a plurality of pilot channels or breaches 4 may be formed in the top 2 in known manner at intervals from one another.

In accordance with the invention, a plurality of massive elements 5 (three in FIG. 1) of a material that is not erodible and that is impervious to water, e.g. metal or concrete, are disposed side by side and touching one another in the pilot breach 4 in order to close it. The elements 5 may be placed directly on the bottom 6 of the pilot breach 4, or preferably on a seating 7 made on or placed on the bottom 6 of the pilot breach 4. Sealing members (not shown) are disposed between the elements 5 and between the elements and the flanks 8 and 9 of the pilot breach 4, and also between the elements 5 and the seating 7.

Figure 2:
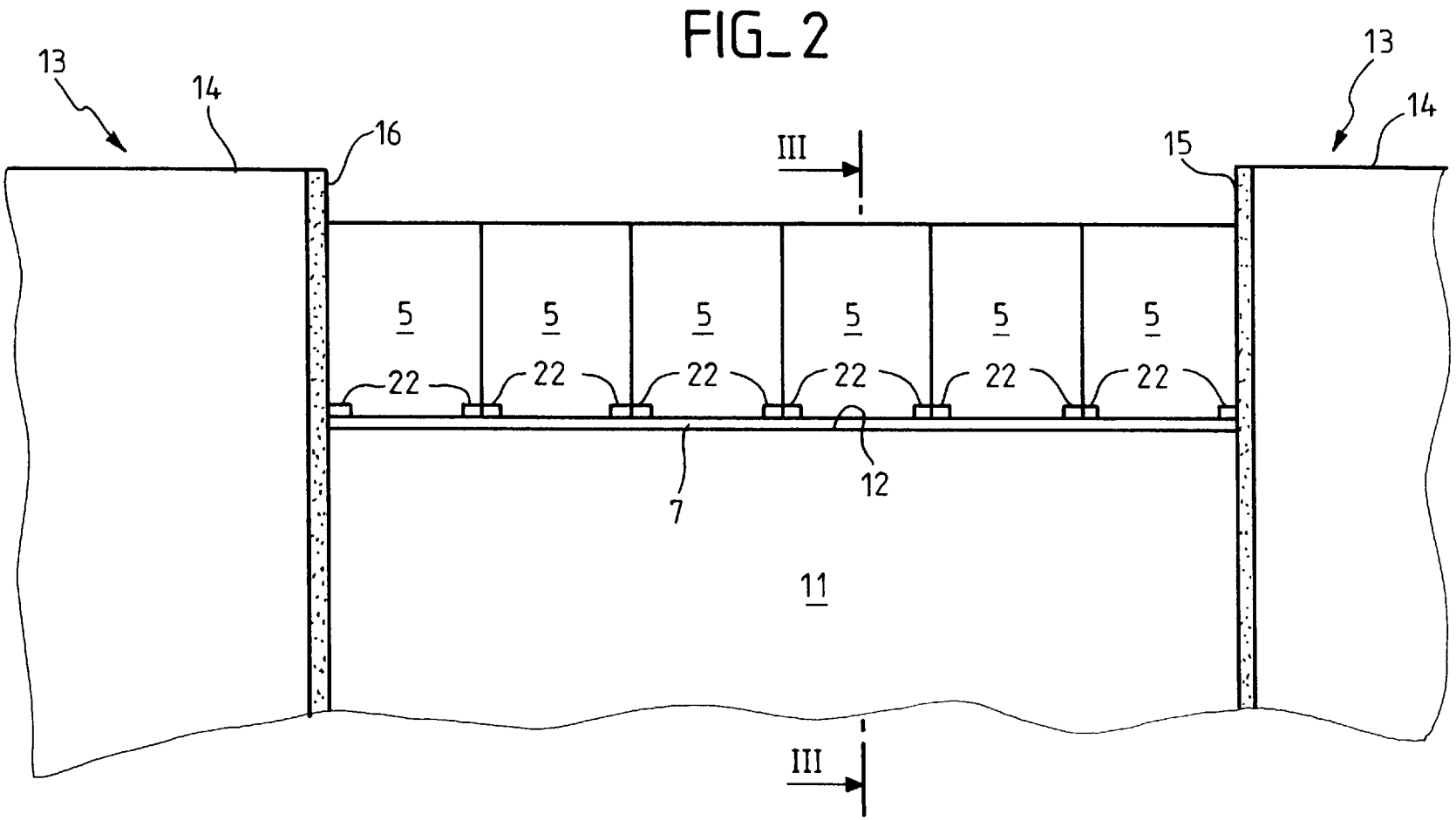
FIG. 2 is a front elevation view showing a dam and its fuseplug dike with a trigger device of the invention installed on the top thereof.

FIG. 2 shows another embodiment of the invention in which a plurality of massive elements 5, e.g. six massive elements, are disposed side by side and touching one another along the full length of the top 12 of a fuseplug dike 11 constituting a portion of an embankment dam 13. The dam 13 may be a main dam or it may be a saddle dam associated with a main dam. Usually, the top 12 of the fuseplug dike-11 is at a lower level than the top 14 of the dam 13. The difference between these two levels is commonly chosen so that in the event of an exceptional flood, water can spill over the top 12 of the fuseplug dike 11 while not being able to spill over the top 14 of the dam 13. The fuseplug dike 11 is laterally defined by two training walls 15 and 16 made of concrete or of masonry, that are intended to restrict destruction solely to the fuseplug dike 11 in the event of water spilling over its top, i.e. preventing the destruction from also spreading to the dam 13. As in the embodiment of FIG. 1, the elements 5 may be placed directly on the top 12 of the fuseplug dike 11 or on a seating 7 that is placed on or is formed on the top 12. Sealing members (not shown) are disposed between the elements 5 and between the elements and the training walls 15 and 16, and also between the elements 5 and the seating 7.

Figures 3, 5A:
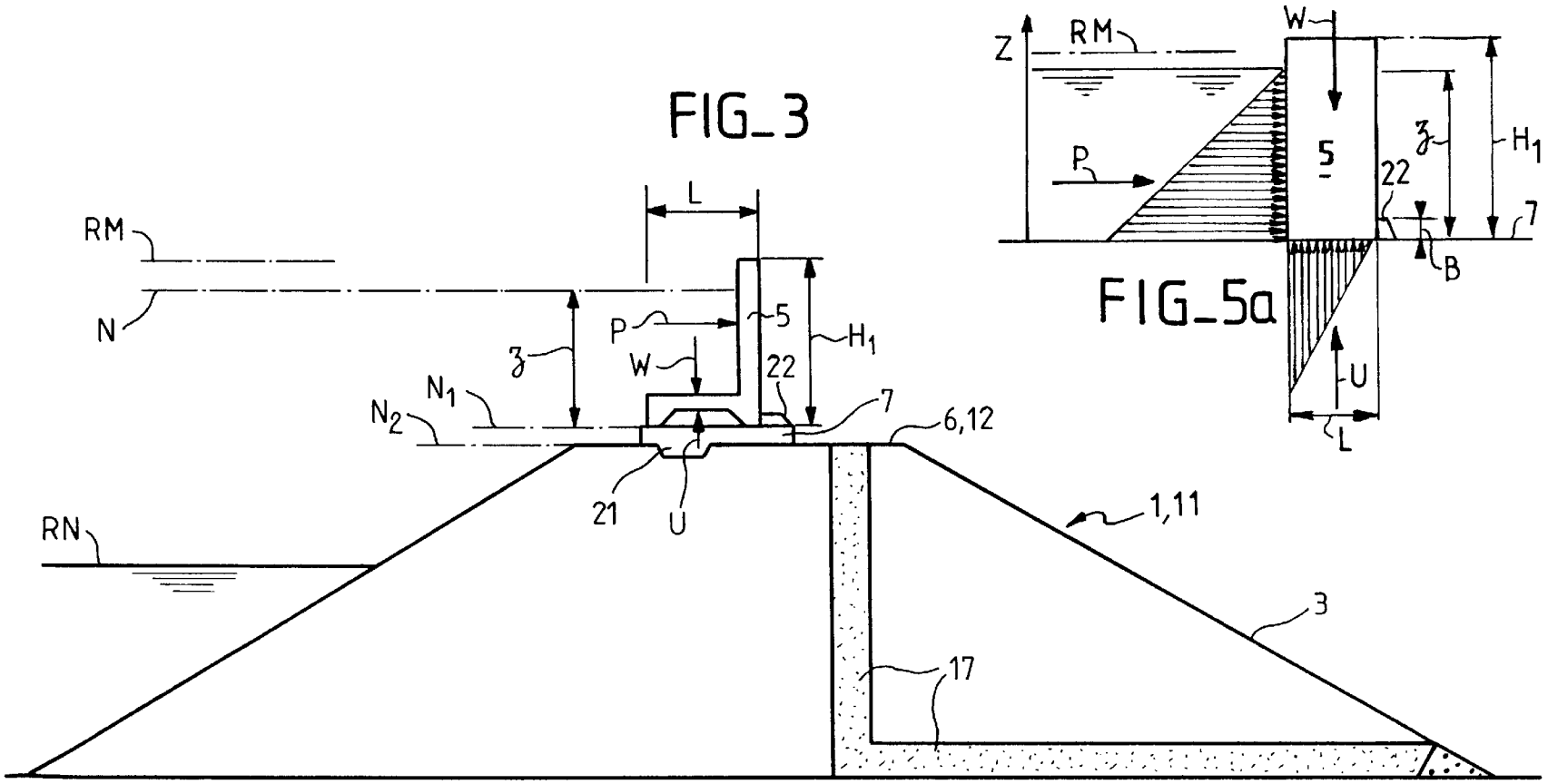
FIG. 3 is a cross-section on line III—III of FIG. 1 or FIG. 2 for a dike made of a material that is uniform and impervious.
FIG. 5*a* is a loading diagram showing the various forces that may be applied to said element in operation, and assuming for the purposes of simplification that the element is in the form of a rectangular block.
Figure 4:
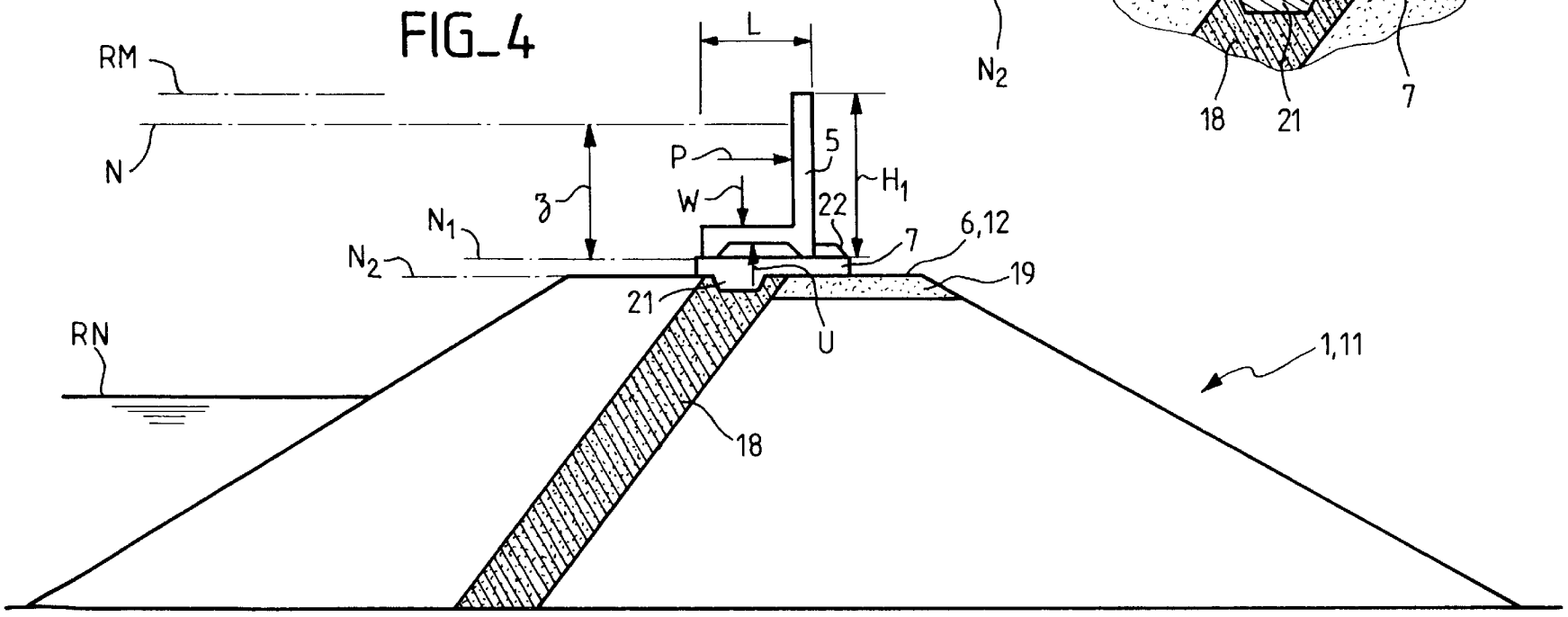
FIG. 4 is a view similar to FIG. 3 for a dike having an impervious core.

FIG. 3 is a standard section through a fuseplug dike made of uniform and impervious material, e.g. clay or clayey sand. Numeral 17 designates a drain, e.g. made of gravel, which drains water that has infiltrated into the embankment of the dike out to the foot of the downstream slope 3. FIG. 4 shows another standard section for a fuseplug dike, including an impervious core 18 and a draining filter 19. Naturally, the invention is not limited to fuseplug dikes of standard section as shown by way of example in FIGS. 3 and 4. In particular, the dike may include an internal diaphragm or an upstream diaphragm. In which case the upstream diaphragm is preferably extended as far as the seating 7 and is connected thereto.

In FIGS. 3 and 4, RN designates the normal retention level and RM designates the maximum level, i.e. the highest level of water that the dam 13 is designed to withstand. Normally, in the event of exceptional flooding, the fuseplug dike 11 should destruct before the water reaches the maximum level RM. However, it must not destruct too soon or for a water level that is significantly lower than the maximum level RM, since that could cause the dike to be destroyed pointlessly under circumstances when other spillways of the dam are sufficient for discharging the flood water. Under such conditions, a large portion of the water in the reservoir upstream from the dike 1 or 11 would be lost pointlessly and the flood created downstream from the dike due to the dike being breached could be worse than the flood entering the reservoir of the dam. It is therefore desirable for the dike 1 or 11 to destruct reliably and quickly only when the water reaches a predefined level, e.g. the level marked N in FIGS. 3 and 4. This level N is not greater than the maximum level RM and it is preferably selected to be several tens of centimeters lower than the maximum level RM.

In FIGS. 3 and 4 (see also FIG. 5), $N_1$ designates the level of the top surface of the seating 7 which serves as the support surface for the elements 5, and $N_2$ designates the level of the bottom 6 of the pilot breach 4 (in the embodiment shown in FIG. 1) or the level of the top 12 of the fuseplug dike 11 (in the embodiment shown in FIG. 2). The difference $N_1-N_2$ thus represents the thickness of the seating 7 above the bottom 6 or the top 12. By way of example, the seating 7 may be constituted by a metal plate that is several centimeters thick, or by a slab of concrete. The bottom face of the seating 7 may be provided with a heel 21 which penetrates into the dike to prevent the seating 7 from sliding over the bottom 6 of the pilot breach or over the top 12 of the dike. The top face of the seating 7 may also be provided with at least one abutment 22 for each element 5 so as to prevent it from sliding downstream under thrust P exerted by the water against the upstream face of the element 5.

The elements 5 may be built in the same manner as the raising elements described in patent EP-0 493 183 (or in patent EP-0 434 521). Like known raising elements, each element 5 is dimensioned in size and in weight so that, when the water reaches the predefined level N, the moment of the driving forces applied by the water to the element 5 and tending to cause it to topple about the abutment 22 becomes as great as the moment of the opposing forces tending to keep the element 5 in place on the seating 7, and consequently said element 5 becomes unbalanced and is expelled by the water. Said driving forces are the thrust P of the water on the upstream face of the element 5 and the under-pressure (uplift) or upwardly-directed thrust U which may act on the bottom surface of the element 5 and which is due to the existence of possible leaks beneath the element 5 or to the presence of a trigger device as described below. The opposing forces which tend to stabilize each element 5 on the seating 7 are the weight W of the element 5, optionally together with the weight of the volume of water overlying the immersed fraction of the element 5. For example, assuming for simplification purposes that the element 5 is in the form of a rectangular block (FIG. 5*a*) of width L and of height $H_1$, the values of P, U, and W per linear meter of the elements 5, and the values of the corresponding driving and opposing moments are given by the following equations:

$$P = \tfrac{1}{2}\times\gamma_w\times Z^2 \quad (1)$$

$$U = \tfrac{1}{2}\times\gamma_w\times z\times L \quad (2)$$

$$W = \gamma_b\times H_1\times L \quad (3)$$

$$Mm = \tfrac{1}{2}\times\gamma_w\times z^2\times(z/3 - B) \quad (4)$$

$$MmU = Mm + \tfrac{1}{3}\times\gamma_w\times z\times L^2 \quad (5)$$

$$Mr = \tfrac{1}{2}\times\gamma_b\times H_1\times L^2 \quad (6)$$

In the above equations (valid for $3B<z<H_1$), P, U, W, L, and $H_1$ have the meanings given above, B is the height of the abutment 22 ($B\geqq 0$), z is the depth of water above the top surface of the seating 7 (above the level $N_1$), Mm is the driving moment in the absence of under-pressure U, MmU is the driving moment in the presence of under-pressure U, $\gamma_w$ is the unit weight of the water, $\gamma_b$ is the mean unit weight of the element 5, and Mr is the opposing moment. When the water reaches the level N ($z=N-N_1$), i.e. when the element 5 is required to topple about the abutment 22, the following must apply:

$$Mm=Mr \quad (7)$$

in the absence of under-pressure U, or else:

$$MmU=Mr \quad (8)$$

if means are provided for creating under-pressure U.

To implement the present invention, the predefined level N at which the elements 5 are to topple is fixed in advance as described above. The depth of water z corresponding to the difference in level $N-N_1$ and also corresponding to the thickness of the nappe of water that will be released when the elements 5 are unbalanced and expelled by the water, is selected in such a manner that the thickness of the nappe of water obtained in this way will reliably cause the downstream slope 3 of the dike 1 or 11 to be destroyed quickly by hydraulic erosion, and consequently that the dike itself will be destroyed. This selection must be performed as a function of the materials constituting the embankment of the dike 1 or 11. In the past, it has been observed that earthfill dams which have suffered water spill over their tops have never withstood spillage of a nappe of water that is 2 m thick. Consequently, when dimensioning the elements 5 of the present invention, the depth of water z($z=N-N_1$) is preferably selected so as to be not less than 2 m for an earthfill dam or dike. For a rockfill dam, the depth of water z may be greater, with it being possible to determine the value appropriate for the materials used by performing tests on scale models.

With the level N being fixed in advance and with the depth of water z being selected as described above, the level $N_1$ is defined ($N_1=N-z$). When the elements 5 are placed directly on the bottom 6 of the pilot breach 4 (FIG. 1) or on the top 12 of the dike 11 (FIG. 2), the bottom 6 of the breach 4 or the top 12 of the dike 11 is levelled to the level $N_1$ as defined if a new dike is being built or optionally it is lowered to said level $N_1$ if an already-existing dike is being altered. When the elements 5 are placed on seating 7, the bottom 6 of the breach 4 (FIG. 1) or the top 12 of the dike 11 (FIG. 2) is levelled (new dike) or possibly lowered (already-existing dike) to a level $N_2$ that is slightly lower than the level $N_1$ as defined above. The difference in level $N_1-N_2$ corresponds to the thickness of the seating 7 which is placed on or built on the bottom 6 of the pilot breach 4 or the top 12 of the dike 11.

The height $H_1$ of the tops of the elements 5 is preferably selected in such a manner as to be greater than the depth of water $z=N-N_1$ so that water does not spill over the tops of the elements 5 before they topple over, even in the presence of waves in the reservoir. Otherwise, the water spilling over the tops of the elements 5 could, in some cases, cause the embankment at the base of the elements 5 to be scoured on the downstream side thereof. Such scouring could destabilize the elements 5 and cause them to topple over before the water upstream from said elements reaches the level N. Nevertheless, when it is possible to accept a small amount of spillage of short duration over the tops of the elements 5 without that harming the stability of said elements, then the height $H_1$ thereof may be selected so as to be equal to or slightly less than the above-specified depth of water z.

In order to cause the elements 5 to topple more reliably and with greater accuracy concerning the water level at which toppling takes place, a trigger device may be associated with each element 5 so as to generate under-pressure U beneath it when the water level reaches the predefined level N, as is known for the raising elements described in patent EP-0 493 183. To this end, it is possible to use a trigger device such as that shown in FIG. 5, for example. This trigger device has a chamber 23 formed at the base of the element 5, between the element and the seating 7, plus a pressurizing duct 24 whose upper end, e.g. in the form of a funnel, lies at a level that is equal to or slightly lower than the predefined level N, while its lower end opens out into the chamber 23. In normal operation, the pressurization duct 24 puts the chamber 23 into communication with the atmosphere. In contrast, when the water reaches and exceeds the predefined level N at which the raising element is to topple over, the chamber 23 fills with water via the pressurization duct 24 and under-pressure U is created beneath the element 5 so as to cause it to topple over more reliably. In order to prevent the chamber 23 becoming filled too soon by waves whose crests are higher than the predefined level N, and thus in order to avoid the element 5 toppling over too soon, the chamber 23 may include, in known manner, a drainage orifice 25 (FIG. 5) of smaller section than the duct 24. Thus, any leakage of water between the element 5 and the seating 7 and/or any water penetrating into the chamber 23 via the duct 24 because of waves will be discharged via the drainage orifice 25 without under-pressure capable of causing the elements 5 to topple being created in the chamber 23. In contrast, if the mean level of the water reaches in stable manner the predefined level N, then the chamber 23 fills quickly via the duct 24 and in spite of the presence of the drainage orifice 25, until the head of water creates vertical thrust U inside the chamber 23 which co-operates with the thrust P to cause the element 5 to topple over.

Figure 5:
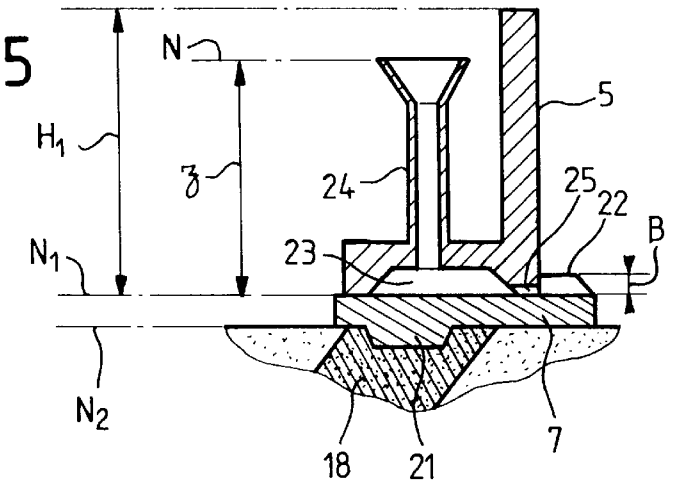
FIG. 5 is a diagrammatic vertical section on a larger scale than FIGS. 3 and 4 showing an element that can be used in accordance with the invention to trigger the destruction of the fuseplug dike.

In addition to, or as a replacement for, the trigger device of FIG. 5, it is possible to provide some other trigger device such as the device show in FIG. 8 of patent EP-0 493 183.

Figure 6A:
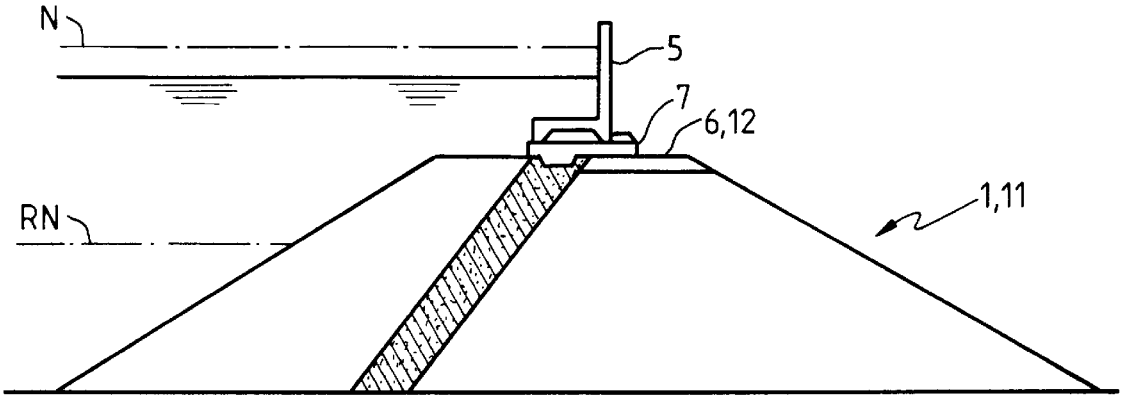
FIGS. 6*a* to 6*e* show various successive stages in the process of the destruction of a fuseplug dike when using one or more elements in accordance with the present invention.
Figure 6B:
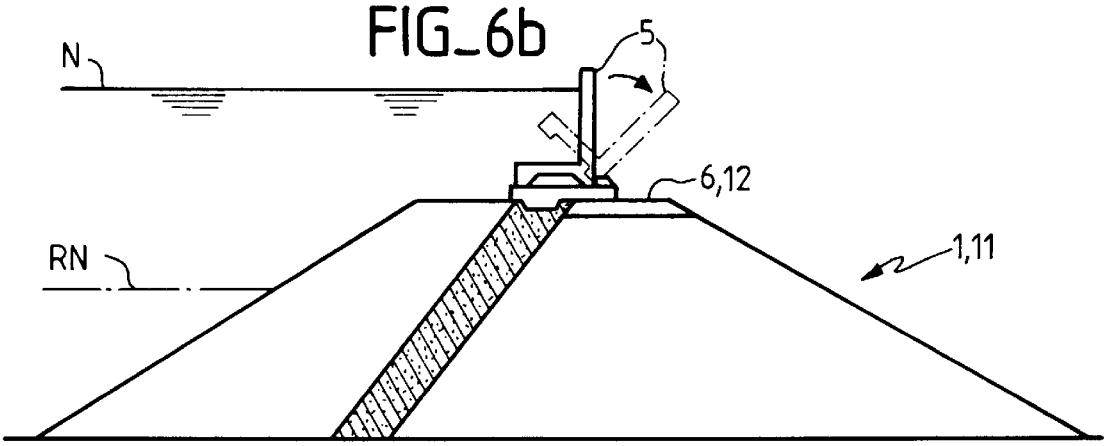
Figure 6C:
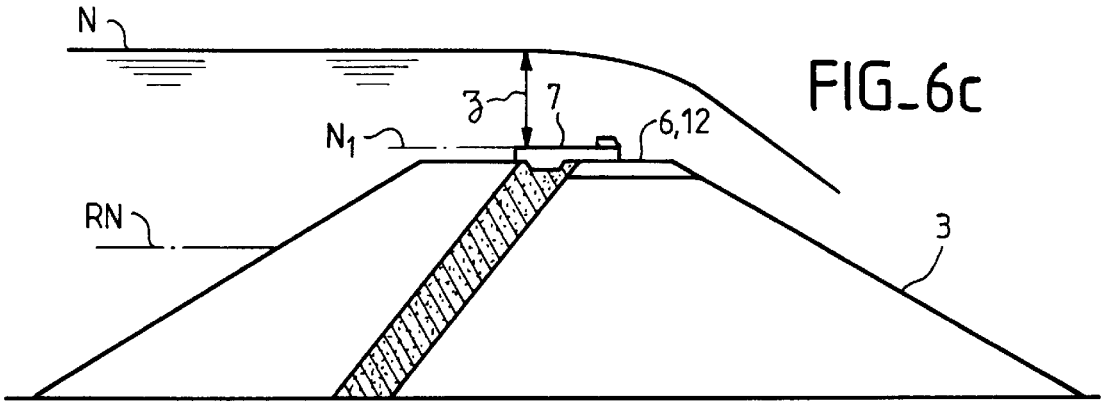
Figure 6D:
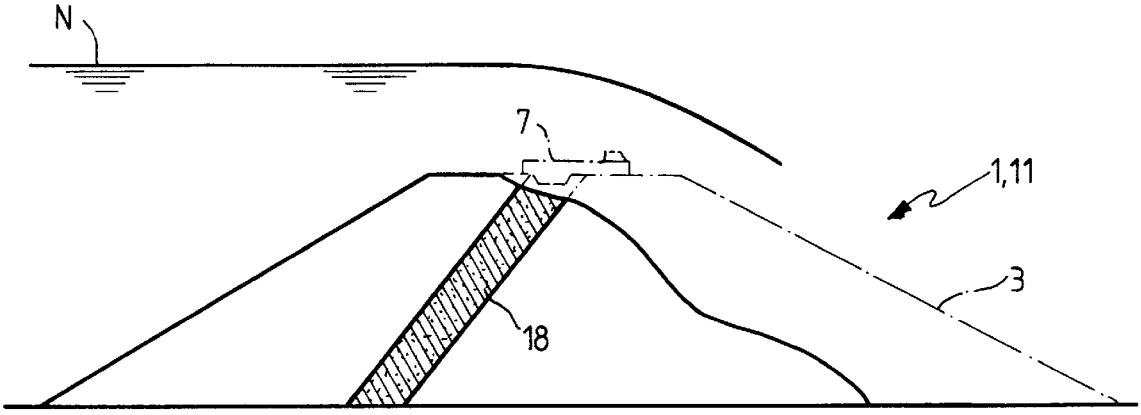
Figure 6E:
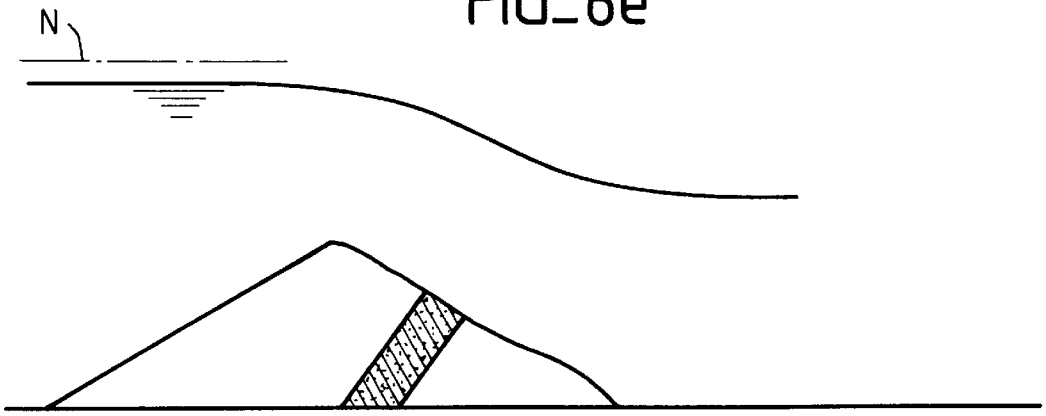

FIGS. 6*a* to 6*e* show several successive stages in the process of destruction of the dike 1 or 11 of FIGS. 1 and 2 in the event of an exceptional flood. In FIG. 6*a* the water has not yet reached the predefined level N. The elements 5 remain stable on their seating 7. When the water reaches the predefined level N, the l elements 5 topple over downstream (FIG. 6*b*) under thrust from the water and, if a trigger device is provided, because of the under-pressure U created beneath the elements 5. The elements 5 are then expelled by the water (FIG. 6*c*), so that a nappe of water of considerable thickness $z=N-N_1$, and of a value that is preferably at least 2 m, spills over the bottom 6 of the pilot breach 4 in the dike 1 or over the top 12 of the fuseplug dike 11, and thence over the downstream slope 3 of the dike 1 or 11. This causes strong erosion and rapid destruction of the downstream slope 3 (FIG. 6*d*) followed by almost total destruction of the selected portion of the dike 1 or of the fuseplug dike 11 (FIG. 6*e*). In FIG. 1, chain-dotted lines show the appearance of the large breach created in the selected portion of the dike 1 after an exceptional flood has passed through it.

Although the embodiments described above refer more particularly to a front-dam or dike, the invention naturally also applies to a levee or a dike that runs along the side of a water course. It should also be understood that the embodiments described above are given by way of example that is purely indicative and nonlimiting, and that numerous modifications can be applied by the person skilled in the art without thereby going beyond the ambit of the invention.

Thus, in particular, equations (1) to (6) given above may vary, e.g. with the shape of the elements 5, with the distribution of the under-pressure U which may be different from that shown in FIG. 5*a* and which may be of uniform distribution, for example, or indeed with the type of trigger device used to create the under-pressure U beneath the elements 5.

I claim:

1. A device for triggering the destruction of a selected portion (1 or 11) of a hydraulic structure confining a water reservoir or a water course, said selected portion of the structure being built of materials that are erodible so that said selected portion can be destroyed by hydraulic erosion, the device being characterized in that said device comprises a seating on or in the top (2 or 12) of said selected portion (1 or 11) at a first predefined level ($N_1$) lower than a maximum water level (RM) for the reservoir or the water course, and at least one massive element (5) made of a material that is not erodible and that is impervious to water, said massive element (5) being disposed on said seating and held thereon by gravity, said massive element (5) being dimensioned in size and in weight so as to be expelled by the water when the water reaches a second predefined level (N) lying between said first predefined level ($N_1$) and said maximum water level (RM), the first predefined level ($N_1$) and the vertical dimension of said massive element measured beneath said second predefined level (N) being selected in such a manner that a nappe of the water, which is released after said massive element has been expelled, is of a thickness (z) suitable for causing reliable and rapid destruction of said selected portion (1 or 11) of the hydraulic structure.

2. A device according to claim 1, characterized in that a chamber (23) is formed between the base of the massive element and a surface supporting the massive element; and in that pressurization means (24) are provided to fill said chamber (23) with water and create upwardly-directed thrust (U) under the massive element (5) when the water of the reservoir or the water course reaches said second predefined level (N).

3. A device according to claim 2, characterized in that said pressurization means comprises a duct (24) having a lower end opening out into said chamber (23) and an upper end which is situated at a level corresponding to said second predefined level (N).

4. A device according to claim 3, characterized in that said chamber (23) includes a drainage orifice (25) of section that is smaller than the section of the duct (24).

5. A hydraulic structure in which at least a selected portion (1 or 11) is built out of material enabling said selected portion, to be destroyed by hydraulic erosion so as to enable an exceptional flood to be discharged via the selected portion of the structure which is destroyed without the remainder of the structure or other structures associated therewith being destroyed by the exceptional flood, the top (2 or 12) of said selected portion (1 or 11) of the structure being at a first predefined level lower than a maximum water level (RM) that the remainder of the structure or the structures associated therewith are designed to withstand, the structure being characterized in that at least one portion of the top (2 or 12) of said selected portion (1 or 11) of the structure is prepared to receive at least one massive element (5) which is placed and held by gravity on said prepared portion of the top (2 or 12), said massive element (5) being dimensioned in size and in weight in such a manner as to be expelled by the water when the water reaches a second predefined level (N) lying between said first predefined level ($N_1$) and said maximum water level (RM), the first and second predefined levels ($N_1$ and N) being selected in such a manner that the difference (z) between the first and second predefined levels gives rise, once said massive element (5) has been expelled, to a nappe of water whose thickness causes reliable and rapid destruction of said selected portion (1 or 11) of the hydraulic structure.

6. A hydraulic structure according to claim 5, characterized in that the difference (z) between the first and second predefined levels ($N_1$ and N) is at least 2 meters.

7. A hydraulic structure according to claim 5, characterized in that the top (12) of the selected portion (11) of the structure is levelled or lowered to a level ($N_2$) a little below the first predefined level ($N_1$), and in that a seating (7) is prepared on the levelled or lowered top (12) in such a manner that the top surface of the seating (7) is at said first predefined level ($N_1$) and serves as the support surface for said massive element (5).

8. A hydraulic structure according to claim 7, characterized in that an abutment (22) is provided of predetermined height on the seating (7) at the foot of the massive element (5) and on the downstream side thereof.

9. A hydraulic structure according to claim 5, characterized in that a pilot breach (4) is formed in the top (2) of the selected portion (1) of the structure with the bottom (6) thereof being levelled or lowered to a level ($N_2$) a little below said first predefined level ($N_1$), and in that a seating (7) is prepared on the bottom (6) of the pilot breach (4) in such a manner that the top surface of the seating (7) is at said first predefined level ($N_1$) and serves as the support surface for said massive element (5).

10. A hydraulic structure according to claim 5, characterized in that a trigger device is associated with the massive element (5) to create upwardly directed thrust (U) beneath the massive element when the water level reaches the second predefined level (N).

11. A hydraulic structure according to claim 10, characterized in that the trigger device comprises a chamber (23) formed between the base of the massive element and a surface supporting the massive element, together with a duct (24) having a lower end which opens out into said chamber (23) and an upper end which is situated at a level corresponding to said second predefined level (N), such that said chamber (23) is filled with water via said duct (24) when the water reaches said second predefined level (N).

12. A hydraulic structure according to claim 11, characterized in that the chamber (23) includes a drainage orifice (25) of section that is smaller than the section of the duct (24).

13. A hydraulic structure according to claim 5, characterized in that a plurality of massive elements (5) are disposed side by side on the seating (7) in the longitudinal direction of the top (2 or 12) of said selected portion (1 or 11) of the structure.

14. A method of destroying a selected portion (1 or 11) of a hydraulic structure confining a water reservoir or water course, said selected portion of the structure being built of materials that are erodible by water, said method comprising the steps of providing a known massive element (5) dimensioned in size and in weight in such a manner as to be expelled by a mass of water in said water reservoir or water course when the level of said mass of water reaches a predefined level (N), and placing said massive element (5) on a seating (7) on or in the top (2 or 12) of said selected portion (1 or 11) of the hydraulic structure, a vertical dimension of said massive element (5) measured beneath said predefined level (N) being further selected in such a manner that a nappe of the water, which is released after said massive element (5) has been expelled, is of a thickness (z) suitable for causing reliable and rapid destruction of said selected portion (1 or 11) of the hydraulic structure by hydraulic erosion.

* * * * *